US006029308A

United States Patent [19]

Smith

[11] Patent Number: 6,029,308

[45] Date of Patent: Feb. 29, 2000

[54] MOP WITH QUICK CONNECT AND RELEASE CONNECTOR BETWEEN THE HANDLE AND THE MOP HEAD

[75] Inventor: Jerry E. Guido Smith, St. Charles, Ill.

[73] Assignee: Fas-Lok Systems, Inc., Aurora, Ill.

[21] Appl. No.: 08/955,760

[22] Filed: Oct. 22, 1997

[51] Int. Cl.[7] ..... A47L 13/24

[52] U.S. Cl. ..... 15/229.2; 15/145; 15/147.1; 15/228

[58] Field of Search ..... 15/145, 147.1, 15/228, 229.1–229.9

[56] References Cited

U.S. PATENT DOCUMENTS

| | | |
|---|---|---|
| 1,420,639 | 6/1922 | Sturgis . |
| 3,145,406 | 8/1964 | Lay . |
| 3,432,873 | 3/1969 | Moss . |
| 3,639,950 | 2/1972 | Lutz et al. . |
| 3,795,934 | 3/1974 | Moss . |
| 4,150,464 | 4/1979 | Tracy . |
| 4,171,555 | 10/1979 | Bakker et al. . |
| 4,306,326 | 12/1981 | Kim . |
| 4,433,931 | 2/1984 | Malish et al. . |
| 4,648,738 | 3/1987 | Thielen . |
| 4,825,515 | 5/1989 | Wolterstorff, Jr. . |
| 4,831,694 | 5/1989 | Kong . |
| 5,066,162 | 11/1991 | Wall et al. . |
| 5,207,754 | 5/1993 | Harrah . |
| 5,222,279 | 6/1993 | Frano et al. . |
| 5,375,286 | 12/1994 | Harrah . |

FOREIGN PATENT DOCUMENTS

| | | |
|---|---|---|
| 200733 | 7/1949 | United Kingdom . |
| 626918 | 7/1949 | United Kingdom . |

*Primary Examiner*—Randall E. Chin
*Attorney, Agent, or Firm*—Kenneth W. Iles

[57] ABSTRACT

A mop with a quick-release connector for connecting a handle to a mop head comprises a female section for attachment to the handle and a male fitting for attachment to the mop head. The male fitting includes a flat thin base portion that is sewn into the mop head. The female section has plurality of receptacles which mate with a similar plurality of bayonet projections in the male section. At least one of the bayonet projections is resiliently flexible and flexes outwardly when the male section is pushed into the female section so as to mate with one another and be securely gripped by an indentation in the female section, providing a positive interlock between the female and male sections. Another of the bayonet projections is a central, rigid, longer bayonet, which acts as a guide when the two sections are connected together.

4 Claims, 5 Drawing Sheets

MOP WITH QUICK CONNECT AND RELEASE CONNECTOR BETWEEN THE HANDLE AND THE MOP HEAD

BACKGROUND OF THE INVENTION

1. Field of the Invention.

The present invention is related to an apparatus for mopping floors. More particularly, the present invention is related to a mop having a quick connect and release connector for fastening and unfastening the mop head from a handle that can be used with other implements.

2. Description of Related Art Including Information Disclosed Under 37 C.F.R. Sections 1.97–1.99.

Mops for mopping floors conventionally incorporate handles that are removable from the mop head. Mops have long employed various types of connection mechanisms to connect the mop head with the handle because the mop head wears our long before the handle does. Further the mop heads are typically cleaned by washing them in a washing machine during their useful life, which requires removing the mop head from the handle. Quite often, these connection mechanisms employ rivets, bolts, screws, and so forth, which must be removed and reinstalled when the mop head is removed from the handle. This tends to be a time-consuming operation and may be beyond the skill level of the typical relatively unskilled worker who uses the mop. Further, removing the mop head from the handle of a conventional mop requires handling the mop head, which is typically dirty, wet, and, perhaps, unsanitary.

Many prior art connectors between the handle and implement have been difficult to align and assemble and prone to excessive wear from the repeated removal and reinstallation of the rivets, bolts, and so forth. Furthermore, these designs have been unable to withstand the considerable tensile, shear and torsional forces constantly imposed upon a mop head during typical use.

It is not unusual for an institutional user, for as a hospital, fast food restaurant or the like to wear out a mop head in as little as a few days. These prior art connection designs have tended to be rather complex, expensive, and have greatly added to the cost, bulk and weight of the typical mop head.

A significant advance in connectors for mop heads and the like was disclosed in Harrah U.S. Pat. No. 5,207,754 and Harrah U.S. Pat. No. 5,375,286, which are hereby incorporated by reference. Harrah '754 and '286 disclose a quick connect and release mechanism utilizing a male connector having a bayonet fitting and a mating female fitting that snap together and are released by depressing a pair of opposed outer bayonets. Harrah '754 specifically discloses a device for permanently attaching the male portion of the connector to a mop head. The device comprises of a circular plate molded onto the bottom of the male connector. The plate includes three downwardly projecting cylindrical studs spaced to form the corners of a triangle. A second plate includes aligned apertures. The male connector is placed on the upper central surface of a mop head and the studs are pushed through the mop head. The lower plate is placed under the mop head in alignment with the upper plate and the two plates are mated by pushing the studs through the apertures. Then the studs are sonically welded to the lower plate by swagging the distal end of each stud or prong to be larger than the apertures, or by other permanent bonding technique.

This means for attaching the mop head to the male connector works reasonably well but has encountered difficulties in practice. The sonic welding equipment required to bond the pieces together is very expensive and is sometimes balky. Further, this fastener often fails in use.

Therefore, a need exists for a mop having a quick connect and release connection between the mop head and the mop handle, that is sturdy enough for rugged use and that is inexpensive to make.

SUMMARY OF THE INVENTION

Accordingly, it is a primary object of the present invention to provide a mop having a quick connect and release connection between the mop head and the mop handle that is sturdy enough for rugged use.

It is another object of the present invention to provide a mop having a quick connect and release connection between the mop head and the mop handle that is inexpensive to make.

These objects are achieved by providing a quick connect and release male connector having a relatively thin and relatively large based molded to it, which is sewn into a mop head.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENT

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
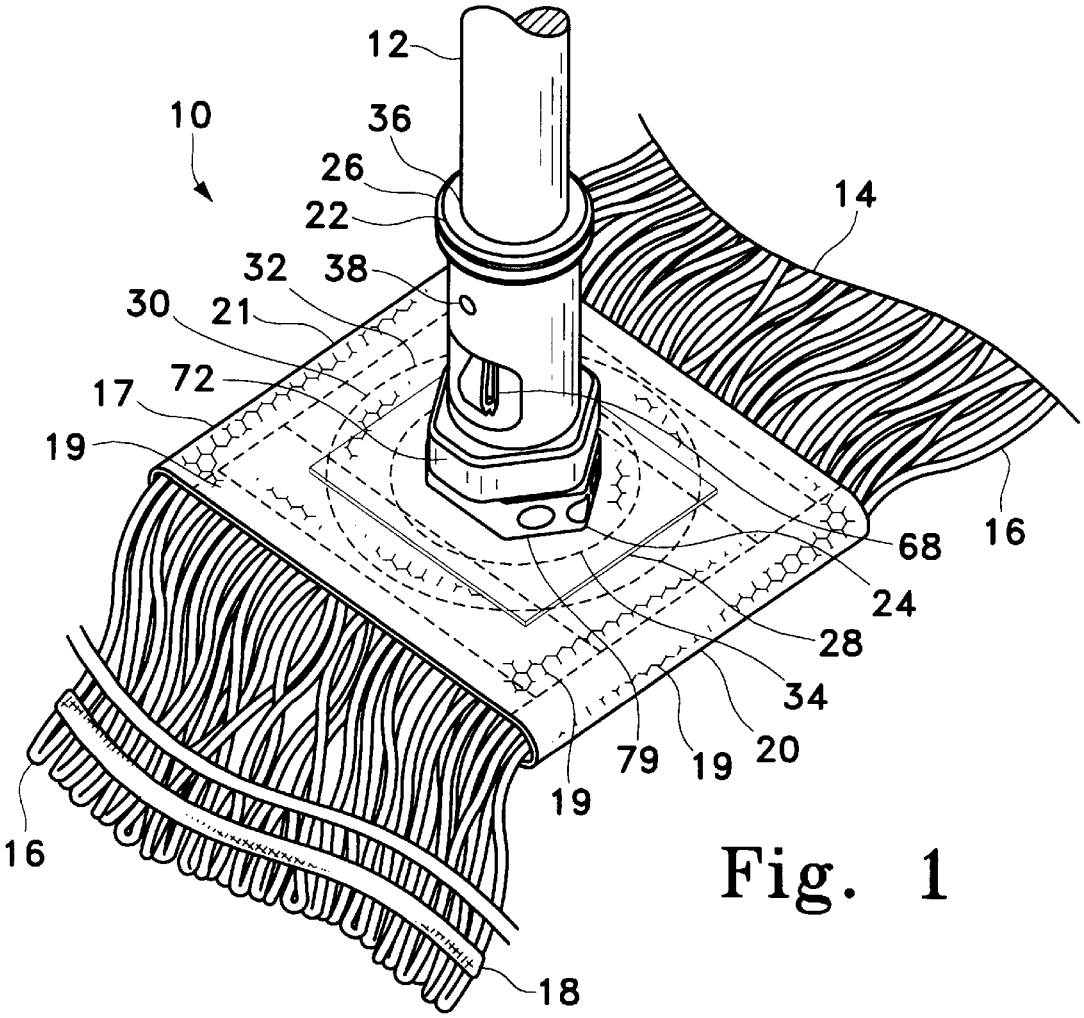
FIG. 1 is perspective view of a mop according to the present invention.
Figure 2:
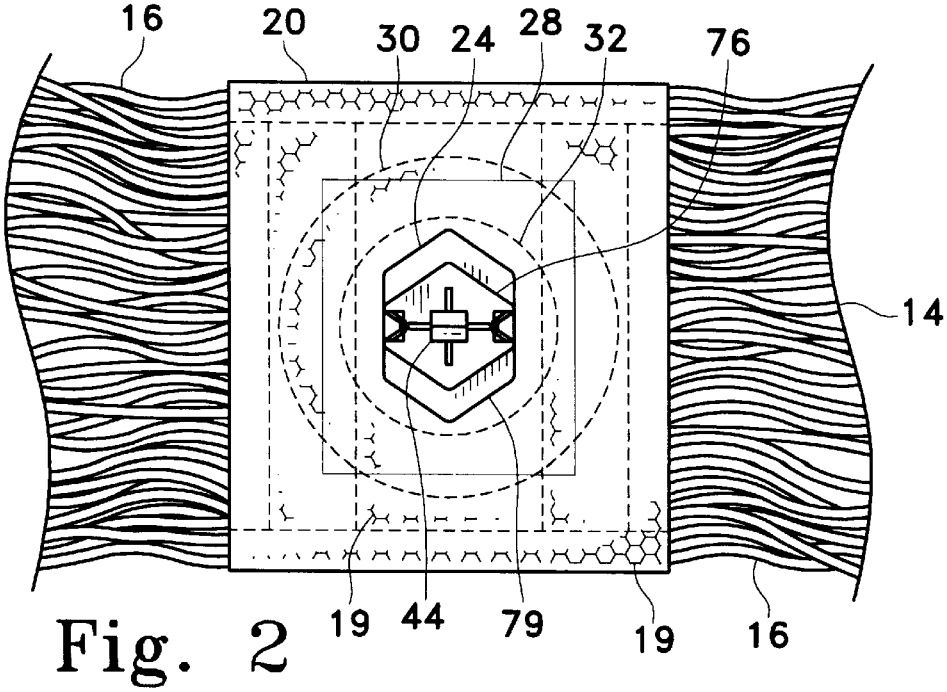
FIG. 2 is a top plan view of a mop head portion of the mop of FIG. 1, having the male connector attached.
Figure 3:
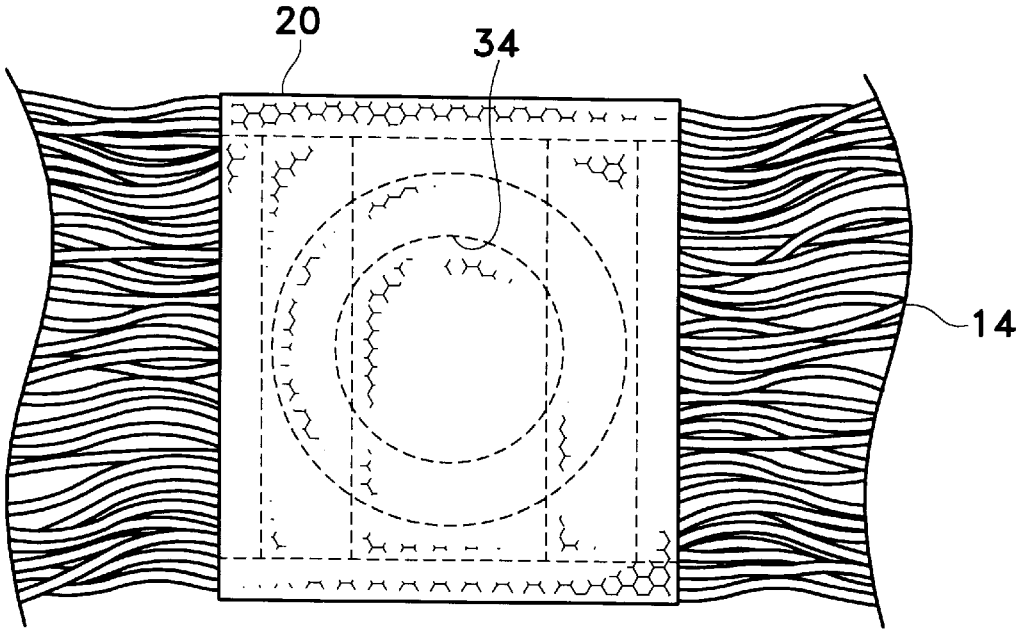
FIG. 3 is a bottom plan view of the mop head of FIG. 2
Figure 4:
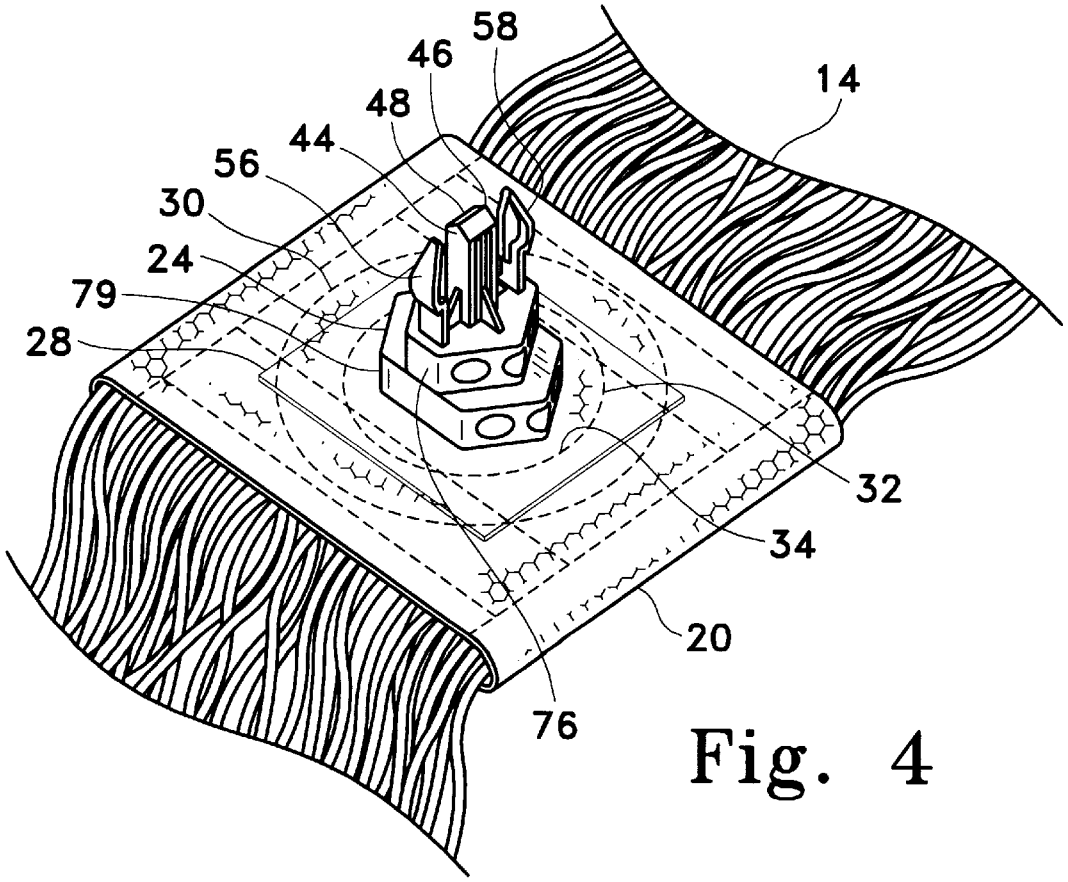
FIG. 4 is a top perspective view of the mop head of FIG. 2.

Referring now to FIGS. 1–3, there is shown a mop with quick connect and release connector between the handle and mop head 10, or mop 10, according to the present invention. The mop 10 includes a handle 12 that is essentially cylindrical and in the range of 4–6 feet long (1.2–1.85 m) and 1½–2½ inches in diameter (3.8–9 cm). The handle allows a mop head 14 to be pushed back and forth across a floor or other surface. The mop head 14 may be made of any suitable material, that is, a material that is absorbent and durable, such as the cotton cords 16 shown in FIGS. 1–4, which are bound in generally parallel spaced relationship by the sewn band 18. One band 18 is sewn onto the set of cords 16 on each side of the center of the mop head 14. The central portion of the mop head 14 includes a broad fabric band 20 sewn to the cords by the stitching 19 to hold the cords 16 in the desired relationship and to provide a base 21 for the mop head 14.

A quick connect and release connector 22 connects the mop head 14 to the handle 12 and allows for quickly connecting or disconnecting the mop head 14 from the handle 12.

The connector 22 includes a male fitting 24 (best seen in conjunction with the mop head 14 in FIG. 4) and a female fitting 26, both integrally molded from a suitable plastic material. The male fitting 24 is releasably mated in the female fitting 26.

Figure 10:
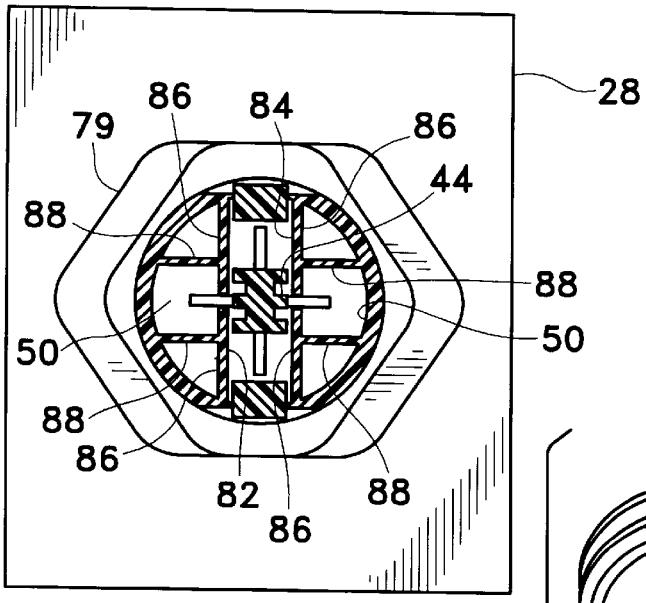
FIG. 10 is a cross section of the connector taken along lines 10—10 of FIG. 5.
Figure 7:
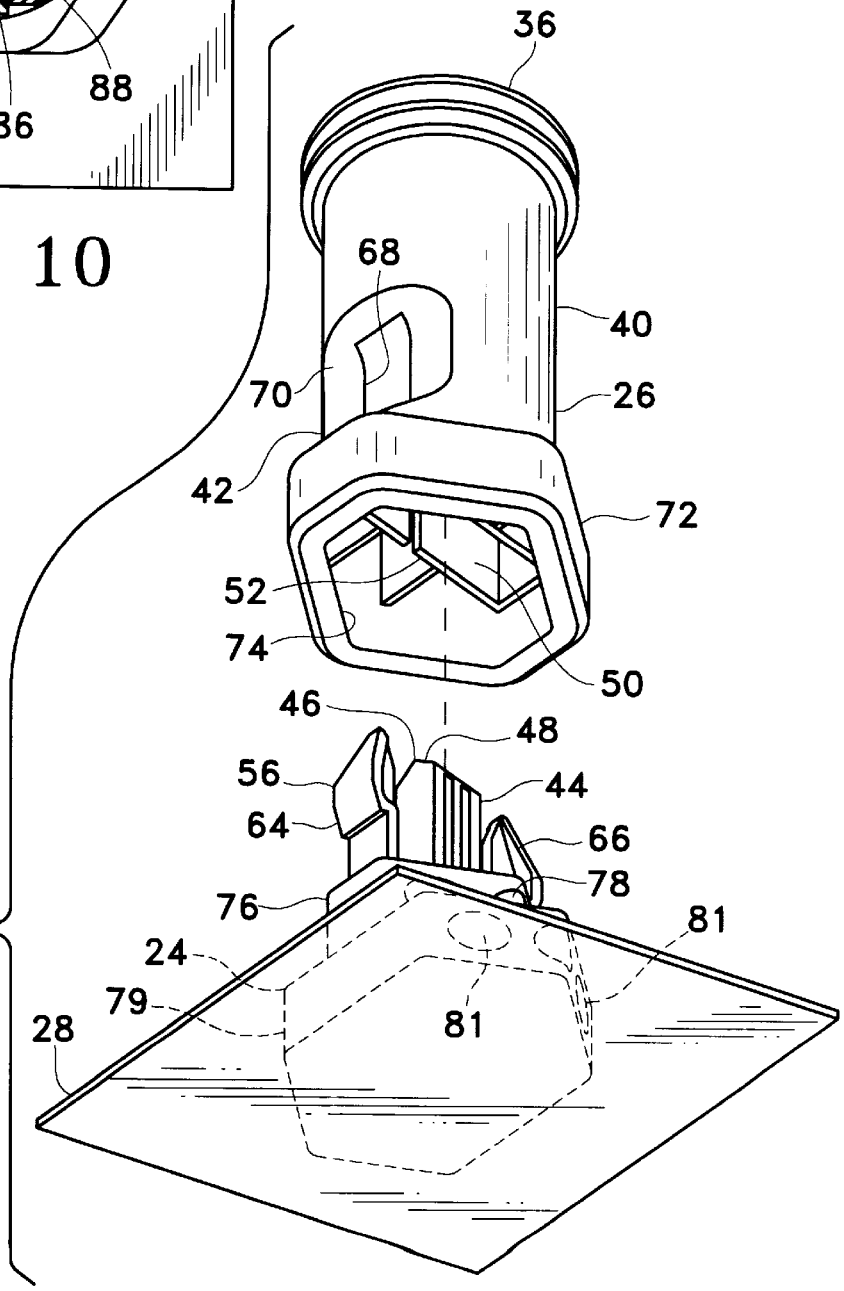
FIG. 7 is an exploded perspective view of the connector portion of the mop of FIG. 1 showing principally the female portion of the connector of FIG. 1.

Referring to FIGS. 1 and 2, and best seen in isolation in FIGS. 7 and 10, the male fitting 24 includes a square shaped flat thin base section 28 that is sewn into the broad fabric band 20 by the circular pattern stitching 30, 32, with the male fitting 24 of the connector 22 protruding through an opening 34 in the broad fabric band 20 and the remainder of the base located under the fabric band 20. The flat thin base section 28 may be stitched directly to the exterior of the broad fabric band 20, but in the preferred embodiment, it is sewn below the upper layer of fabric in the band 20 but above the mop's cotton cords 16. The outlines of the flat thin base section 28 are shown in thin solid lines in the drawing figures despite the fabric covering it because use of hidden lines would be unduly confusing and the outlines of the flat thin base section 28 are visible through the fabric of the band 20 sometimes.

Figure 5:
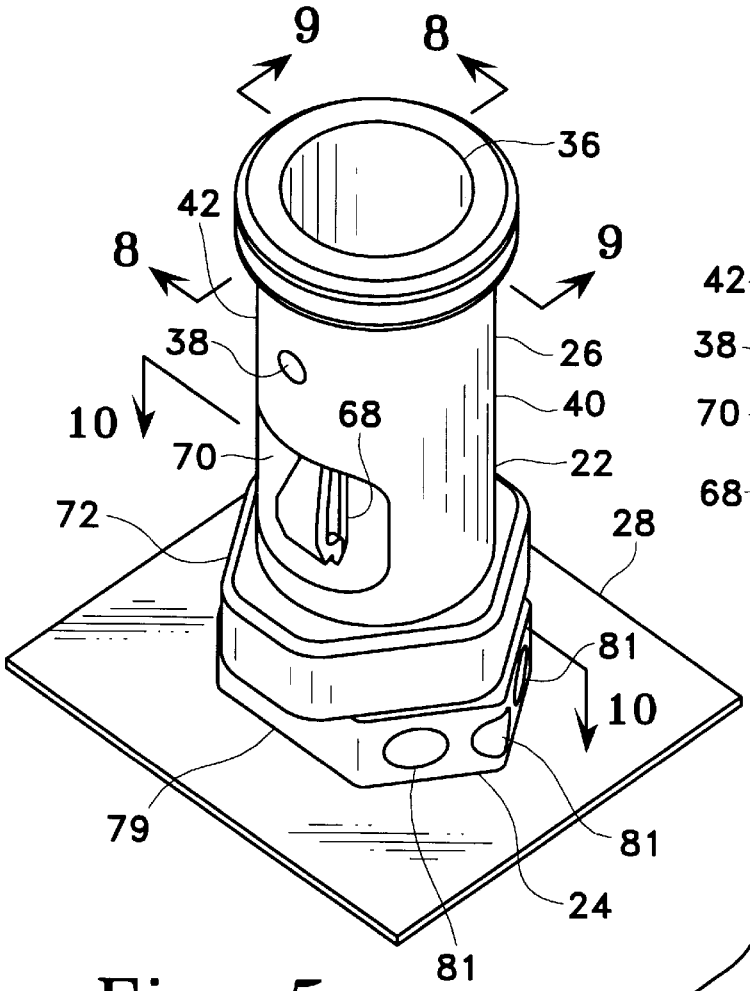
FIG. 5 is a perspective view of the assembled connector of FIG. 1

Referring now to FIG. 5, the assembled connector 22 is shown with the female fitting 24 mated to the male fitting 24. The handle 12 is inserted into a cylindrical opening or cavity 36 at the top of the female fitting 26. If desired, a screw, pin, or the like may be inserted through the aperture 38 in the cylindrical side wall, or side wall 40, of the female fitting 26 to secure the handle 12, which may also be retained in the female fitting by frictional engagement.

Figure 6:
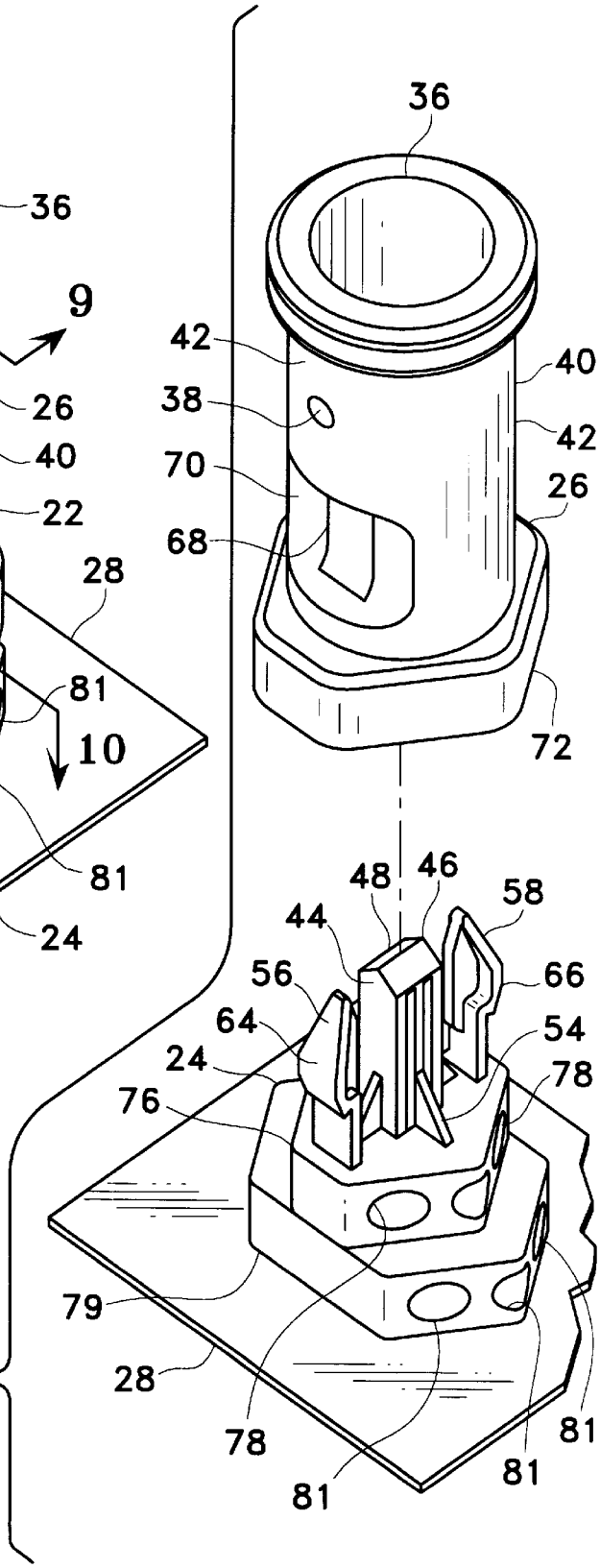
FIG. 6 is an exploded perspective view of the connector portion of the mop of FIG. 1 showing principally the male portion of the connector of FIG. 1.

Referring now to FIG. 6, the female fitting 26 includes an upwardly projecting cylindrical member 42 having the cylindrical cavity 36 for securing an implement handle 12, as discussed above. The male fitting 24 includes a rigid central upward projecting bayonet 44 having a tip 46 including a locating wedge 48 for mating with a cavity 50 formed by certain webbing 52 in the lower portion of the female fitting 26 (See FIG. 7). The central bayonet 44 serves as a guide in aligning the male fitting 24 inside the female fitting 26 and the various cavities involved in the mating of the fittings. The central bayonet 44 is reenforced by four upstanding triangular skirt members 54, which are equally spaced about the perimeter of the central bayonet 44. The male fitting 24 further includes a pair of outer bayonets 56, 58, which are flexible and engage mating cavities 82, 84, in the lower portion of the female fitting 26. The outer bayonets 56, 58 each include an outwardly projecting curved portion 64, 66 respectively, which extend beyond the side wall 40 of the female fitting 26 through slots 68, in an indented portion 70 of the side wall 40 of the female fitting 26.

In use, the worker depresses the outer bayonets 56, 58 at the curved portions 64, 66, thereby releasing the bayonets 56, 58 and allowing the male fitting 24 and the female fitting 26 to disengage. To engage and lock the female 26 and male 24 fittings are simply aligned and pushed together. When the flexible outer bayonets 56, 58 snap into the slots 68 the fittings are locked together.

Referring to FIGS. 7 and 10, the base portion 72 of the female fitting 26 includes a six sided receptacle 74 or cavity that receives a mating six sided mating base portion 76 of the male fitting 24. The mating six sided mating base portion 76 fits snugly within the mating cavity 74 of the female fitting 26. The patterns of the bases 72, 76 may be any desired pattern, but it has been found that the irregular hexagonal shape illustrated in the Figures provides good stability between the male and female fittings, 24, 26 respectively of the connector 22. It is this fitting together of these two pieces, which are manufactured to very close tolerances, that provides much of the lateral stability of the connector 22. The mating base portion 76 of the male fitting 24 includes three parallel cylindrical openings 78, which are designed to provide equal wall thickness in the piece to prevent warping during cooling after injection molding. The male fitting 24 further includes a pedestal base portion 79 lying between the square-shaped flat thin base 28 and the mating base portion 76. The pedestal base portion 79 has substantially the same shape as the mating base portion 76, but has a larger footprint, that is a greater perimeter, which provides more plastic material connecting the flat thin base 28 with the remainder of the male fitting 24, thereby providing a stronger and more stable connection between the male fitting 24 and the mop head 14. The pedestal base portion 76 also serves as a stop for the female fitting 26 and makes it easier to sew the flat thin base portion 28 into the mop head 10 by elevating most of the male fitting 24 above the mop head 14. The pedestal base portion 76 includes three parallel cylindrical holes 81 for the reasons discussed above in connection with the cylindrical openings 78.

Figure 8:
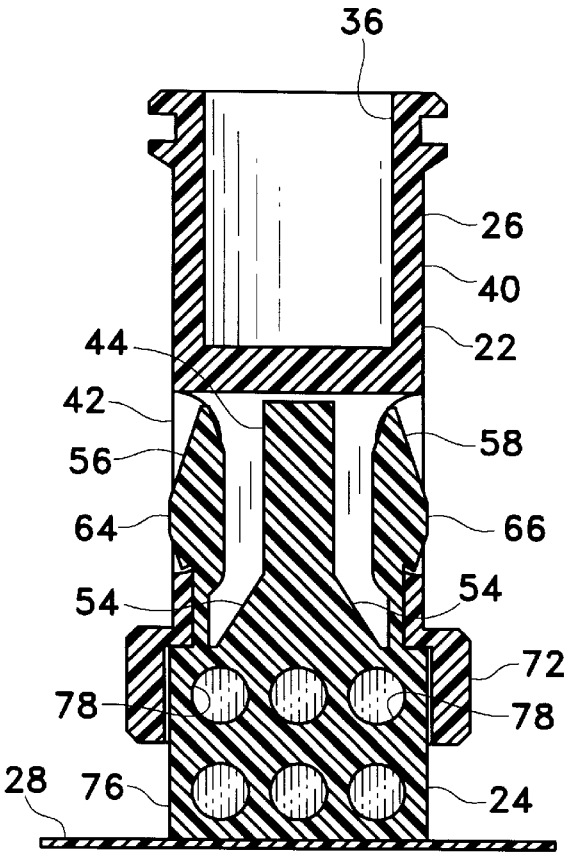
FIG. 8 is a cross section of the connector taken along lines 8—8 of FIG. 5.
Figure 9:
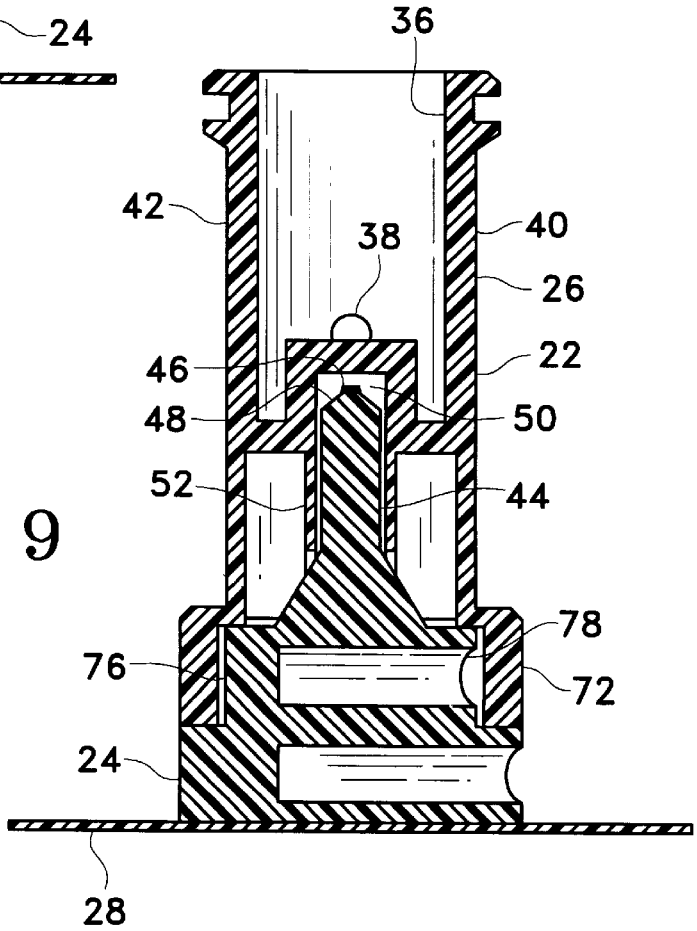
FIG. 9 is a cross section of the connector taken along lines 9—9 of FIG. 5.

FIGS. 8 and 9 show the connector 22 in cross sectional views that illustrate the engagement of the bayonets 44, 56, and 58 and the receiving cavities.

Referring to FIG. 10, a central bayonet receiving cavity 50 is formed by the webbing 52 and outer bayonet receiving cavities 82, 84 are formed by the webbing 86. Reenforcing webbing 88 allows the female fitting 26 of the connector 22 to use reduced amounts of materials while retaining the strength required for vigorous and forceful mopping.

Preferably the fittings of the present invention are constructed of a nylon which has a high strength-to-weight ratio. Other thermoset resins or the like may be used with equal effectiveness. Such materials are readily molded into the desired shapes and are economical enough to permit their disposal with used mop heads.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A mop comprising:

a. a mop head having a plurality of generally parallel spaced absorbent cords and a band encompassing a central portion of said generally parallel spaced absorbent cords;

b. a male fitting comprising a flat thin base portion fixedly secured to said mop head within said band between said spaced absorbent cords and said band, and said male fitting further comprising at least one bayonet adapted to seat within a bayonet receiving slot of a female fitting;

c. a female fitting having a handle-connecting portion at one end and at least one bayonet receiving receptacle at a bayonet receiving end of said female fitting, said female fitting further comprising a plurality of side walls, said side walls enclosing said bayonet receiving end of said female fitting; and d. a handle inserted into said handle-connecting portion of said female fitting.

2. A mop comprising:

a. a mop head having a plurality of generally parallel spaced absorbent cords and a band encompassing a central portion of said generally parallel spaced absorbent cords;

b. a male fitting comprising a flat thin portion fixedly secured to said mop head within said band and said male fitting further comprising at least one bayonet adapted to seat within a bayonet receiving slot of a female fitting and; said male fitting further comprises an integral pedestal base portion adjacent to and above said flat thin base portion and an integral mating base portion adjacent to and above said pedestal base portion;

c. a female fitting having a handle-connecting portion at one end and at least one bayonet receiving receptacle at a bayonet receiving end of said female fitting, said female fitting further comprising a plurality of side walls, said side walls enclosing said bayonet receiving end of said female fitting and d. a handle inserted into said handle-connecting portion of said female fitting.

3. A mop in accordance with claim 2 wherein said pedestal base portion further comprises a plurality of parallel cylindrical holes therein and said mating base portion further comprises a plurality of parallel cylindrical openings therein.

4. A mop comprising:

a. a mop head comprising a plurality of spaced parallel cords bound together by a fabric band encompassing a central portion of said mop head;

b. a male fitting comprising a flat thin base portion fixedly secured to said central portion of said mop head and lies between said fabric band and said spaced parallel cords, a pedestal base portion adjacent to said flat thin base portion, a mating base portion affixed to and above said pedestal base portion and comprising a bayonet end further comprising a central rigid bayonet flanked by a pair of flexible resilient bayonets and said central rigid bayonet further comprises a locating wedge at a tip portion;

c. a female fitting having a handle-connecting portion at one end and a plurality of bayonet receiving receptacles at a bayonet receiving end of said female fitting, said female fitting further comprising a plurality of side walls, said side walls enclosing said bayonet receiving end of said female fitting, an indentation in at least two opposing side walls and a bayonet tip receiving slot within each said indentation, a plurality of web members within said bayonet receiving end, said web members further comprising means for guiding and receiving said central and said pair of flanking flexible resilient bayonets; with one said web member extending parallel to and coextensive with each said bayonet receiving slot and offset from each said bayonet receiving slot toward a center of said female fitting; and d. a handle removably secured in said handle-connecting portion of said female fitting.

* * * * *